United States Patent [19]

Lancaster et al.

[11] 4,204,377

[45] May 27, 1980

[54] PROCESS AND APPARATUS FOR WRAPPING NETTING MATERIAL AROUND A LOAD

[75] Inventors: William G. Lancaster; Patrick R. Lancaster, both of Louisville, Ky.

[73] Assignee: Lantech, Inc., Louisville, Ky.

[21] Appl. No.: 911,652

[22] Filed: Jun. 1, 1978

Related U.S. Application Data

[63] Continuation-in-part of Ser. No. 709,957, Jul. 30, 1976, which is a continuation of Ser. No. 478,523, Jun. 12, 1974, abandoned.

[51] Int. Cl.[2] ..... B65B 11/04

[52] U.S. Cl. ..... 53/399; 53/441; 53/556; 53/587

[58] Field of Search ..... 53/399, 441, 556, 211, 53/210, 587, 588; 242/7.23, 18 EW, DIG. 2

[56] References Cited

U.S. PATENT DOCUMENTS

| | | | |
|---|---|---|---|
| 1,527,751 | 2/1925 | Seyfarth | 242/18 EW |
| 4,077,179 | 3/1978 | Lancaster et al. | 53/441 |
| 4,136,501 | 1/1979 | Connolly | 53/461 |

FOREIGN PATENT DOCUMENTS

| | | | |
|---|---|---|---|
| 2442971 | 3/1976 | Fed. Rep. of Germany | 242/18 EW |

OTHER PUBLICATIONS

"The Digest", by Infra Pak-Dec. 1977.

*Primary Examiner*—John Sipos

*Attorney, Agent, or Firm*—Gipple & Hale

[57] ABSTRACT

An apparatus and process for automatically making spiral wrapped unitary package having a netting overwrap. In the apparatus a series of loads, each containing a plurality of units are fed one at a time onto a turntable adjacent a netting dispenser with the leading edge of the netting from the netting dispenser being held by a clamp mechanism mounted on the turntable. The netting is spirally wrapped around the load and is then formed into a rope-like configuration by a roper mechanism, with the roped netting being wrapped around the turntable clamp mechanism, at which time the roped netting is clamped by a clamping, tucking and cutting mechanism. The clamping, tucking and cutting mechanism tucks the portion of the roped wrap between the load and the roped netting wrapped around the clamp mechanism and severs the roped netting as the turntable clamp mechanism is retracted below the edge of the turntable causing the roped overwrap to attempt to return to its memory position, holding the severed end of the roped netting in a fixed position as the clamping, tucking and cutting mechanism is raised out of the contracting roped wrap. The new leading edge of the netting is held by the clamping, tucking and cutting mechanism which carries the leading edge back towards the turntable clamp mechanism allowing the netting to be clamped by the turntable clamp for the next operation, at which time the clamping, tucking and cutting mechanism releases the new leading edge of the netting and is removed from the netting dispensing path.

14 Claims, 33 Drawing Figures

100
104
110
102
102
102
10
18
19
14
11
50
108
16
224
106
24
12
28
20
13

50
224
124
41
46
36
44
38
28
24
12
34
30
32
49
48
40

28
24
12
30
32
49
48
38
41
40
46
46
224
36
34

50
52
54
56
58
60
63
66
67
68
70
78
57
24
224

28
124
24
27
26
50

PROCESS AND APPARATUS FOR WRAPPING NETTING MATERIAL AROUND A LOAD

RELATED APPLICATIONS

This is a continuation-in-part of U.S. application Ser. No. 709,957, filed July 30, 1976 which is a continuation of U.S. application Ser. No. 478,523 filed June 12, 1974 and now abandoned.

BACKGROUND OF THE INVENTION

The present invention generally relates to packaging and more particularly to a method and apparatus for making unitary packages which hold a plurality of components, each package containing a load wrapped in a web of stretched netting material.

Case packing or boxing is a common way of shipping multiple unit products. The multiple unit produces are generally stacked in a corrugated box or are wrapped with kraft paper with the ends of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798; 3,626,654; 3,590,509 and 3,514,920. A discussion of this art is set forth in U.S. Pat. No. 3,867,806.

The present invention provides a simple, reliable and inexpensive method of unitizing multiple unit products into a single wrapped package with an overwrap material which cannot take a heat seal.

When the present process and apparatus is compared with other apparatus and processes currently used to pack products in corrugated boxes and the cost of the corrugated boxes themselves, the invention shows an enormous cost savings. The invention has comparable costs with kraft wrap but it gives a much tighter and better unitized package than that possible with kraft wrap. In addition to these factors the invention can use a stretch netting material, stretch mesh material or perforated stretch film which provides product visibility not possible with kraft or corrugated wrapping plus the desirable feature of letting the load "breathe." This feature is especially desirable when live produce is packaged and shipped. Furthermore, the present invention system offers packaging speed, reliability of package seal and energy savings in that less energy is required to package the products.

A basic problem with shrink and non-cling stretch film packaging is that the primary strength and reliability of the package is determined by the consistent quality of the seal. These seals depend on a careful maintenance of the sealing jaw and are never as strong as the film itself. The time that it takes to make the seals is a limiting factor on the possible speeds of most shrink systems with the additional problem that some stretchable materials, as for example stretch netting, cannot be heat sealed.

The present invention does not require a structural seal and therefore can use any type of stretchable material. The invention is designed to function with a stretchable plastic netting material such as that known in the trade as "stretch net" manufactured by Bemis Bag but can be used with other stretchable film webs such as P.V.C. or polyethylene. In the present invention the apparatus utilizes a tucking mechanism which effectively tucks a wrapping of film under the wrap adjacent it while severing the trailing edge of the film from the load after the load has been spirally wrapped.

The use of spiral wrapping machinery is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit an overlapping spiral wrap around the load and returns in the opposite direction to deposit another spiral overwrap around the load. Other spiral wrapping apparatus are described by U.S. Pat. Nos. 3,857,486; 3,788,199; 3,549,017; 3,412,524, 3,191,289 and 2,716,315. The previously indicated patents rely on heat shrink material, adhesives, a heat seal or the tacky nature of the film to hold the outer layer of wrap in a fixed position.

The turntable clamping assembly described in this specification is disclosed in U.S. Pat. No. 4,077,179. Various patents have described the use of mechanisms for wrapping materials. In U.S. Pat. No. 3,003,297 a complex cutting and holding mechanism is used to place tape on a box and cut if off with the process being repeated for each box. The use of adhesive on the tape to bond it to the package is an integral part of the function of this concept. Without this adhesion it would not work either in single, multiple or spiral configurations. The unique design and function of the tucking, clamping and cutting mechanisms in the present invention does not require a bonding or heating of the film in order for the system to operate.

U.S. Pat. No. 2,088,133 discloses a reverse wrapping wire tying machine. In the reference a gripper mechanism holds a band in position with respect to the load to be wrapped and a rotatable ring drive rotates the band around the load until the band has completed more than one wrap of the load and passes over the body of the gripper mechanism. A separator slide is used to separate the leading edge of the band from the underlying band and a second gripper mechanism attaches to the separated band. A heat sealing mechanism welds the wrapped layer band to the band underneath it and a cutting mechanism severs the leading edge of the band held by the second gripper mechanism which then becomes the trailing edge of the succeeding wrap. When the band is severed the ring drive mechanism is rotated in a reverse direction for the following load with the various gripping and cutting mechanisms functioning in the same manner.

Additional references of interest which are pertinent to rotatable drives for wrapping packages are disclosed in U.S. Pat. Nos. 3,820,451, 3,331,312, 3,324,789, 3,309,839, 3,207,060, 2,743,562, 2,630,751, 2,330,629, 2,054,063 and 2,124,770.

Other applications in packaging are shown by U.S. Pat. Nos. 3,514,920 and 3,793,798 in which heat shrink film is wrapped around a pallet supporting a plurality of cartons. A similar full web apparatus using a tensioned cling film is shown by U.S. Pat. No. 3,986,611 while another apparatus using a tacky P.V.C. film is disclosed in U.S. Pat. No. 3,795,086.

The present invention uses stretchable plastic netting in its preferred embodiment since the mechanical stretching of the netting utilizes its strength better than heat shrink wrap and can be used on loads where breathing is necessary or no heat can be applied to the product. The elasticity of the netting or film holds the products under more tension than either the shrink wrap or the kraft wrap particularly with products which settle or relax when packaged.

Various apparatus and processes have been developed by the named inventors of this invention to utilize stretch material in package wrapping. Such apparatus and processes are disclosed in U.S. Pat. Nos. 3,867,806, 4,050,220, 4,077,179 and 4,079,565.

Additional benefits occur in the present invention over the prior art in that no changeover is required in handling random size units of a variety of materials as the apparatus is constructed to handle such random size units. Furthermore, the apparatus provides a substantially continuous wrapping operation so that loads can be wrapped at any desired speed and for any time period. A significant economic factor is also present in the present invention as the power requirements are significantly less than those of shrink systems since there is no heat tunnel required and greater speeds of operation are possible because of the elimination of the conventional heat seal which is used in non cling wrapping. Furthermore a wider number of products can be handled by the present invention because of the elimination of the heat seal requirement. It should also be noted that adhesives do not work efficiently on the netting material due to the lack of gripping surface. Because of the simplicity of the construction of the invention there is a greater stability in the inventive wrapping apparatus with less maintenance being required to maintain the apparatus resulting in a corresponding reduction in breakdown time. Another desired characteristic resulting from the apparatus construction is that the invention does not take up much floor space.

SUMMARY OF THE INVENTION

The present invention generally comprises a novel apparatus and process for automatically making spirally wrapped unitary packages having an overwrap which is not heat sealed. In the apparatus a series of loads, each containing a plurality of units are singularly fed onto a turntable adjacent the spiral wrapping apparatus.

The leading edge of the netting from the netting dispenser is held by a clamp mechanism of the turntable and the turntable is rotated to wrap the load with film and/or netting which is stretched as it is wrapped around the load. The netting or film is spirally wrapped around the load and is then formed into a rope-like configuration. After rotation of the rope-like configuration around the load, a subsequent rope wrap is tucked under an adjacent rope wrap and severed from the netting dispender at which time the overlying rope wrap is released holding the severed end of the roped netting in a fixed position. The new leading edge of the netting is held by the clamping, tucking and cutting mechanism until the netting is clamped by the turntable clamp for the next wrapping operation.

The above-mentioned purposes and operations of the inventor are more readily apparent when read in conjunction with the following description of the drawings and the detailed description of the preferred embodiment of the present invention.

DETAILED DESCRIPTION OF THE DRAWINGS

Figure 1:
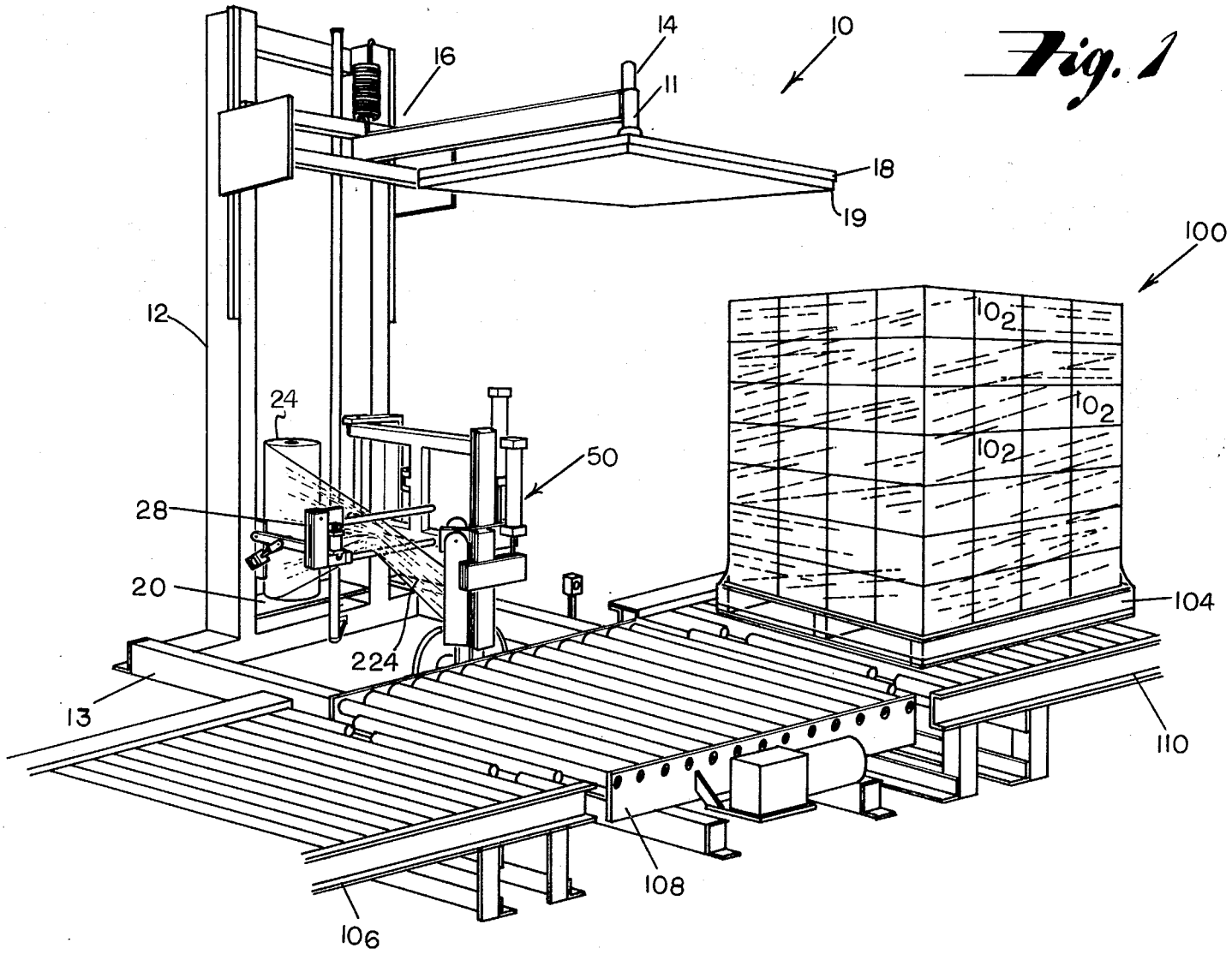
FIG. 1 is a perspective view of the inventive wrapping apparatus.

The spiral wrapping apparatus 10 is most clearly shown in FIGS. 1–5 with the operation of the apparatus and its respective component parts being shown in FIGS. 6–33.

The spiral wrapping apparatus 10 comprises an upright frame 12 sitting on a base 13. A platen assembly 14 is mounted on the frame 12 for movement along the frame. The platen assembly comprises a support structure 16 moveably mounted to the frame and a platen 18 moveably mounted to the support structure. The platen has a flexible lower surface 19 which is adapted to be placed on the top of a load 100 comprising a plurality of unitary members 102 stacked on a pallet 104. The lower surface 19 of the platen is lowered onto the top of the load 100 after the load is carried by power conveyor 106 onto turntable 108.

When turntable 108 is rotated the platen rotates within journal 111 of the platen assembly holding the units in position on the load as the spiral wrap 120 is stretch wrapped around the load. The platen provides a force on the units 102 to prevent the units from being displaced or pulled from the load as the stretched netting material is wrapped around the load.

Figure 11:
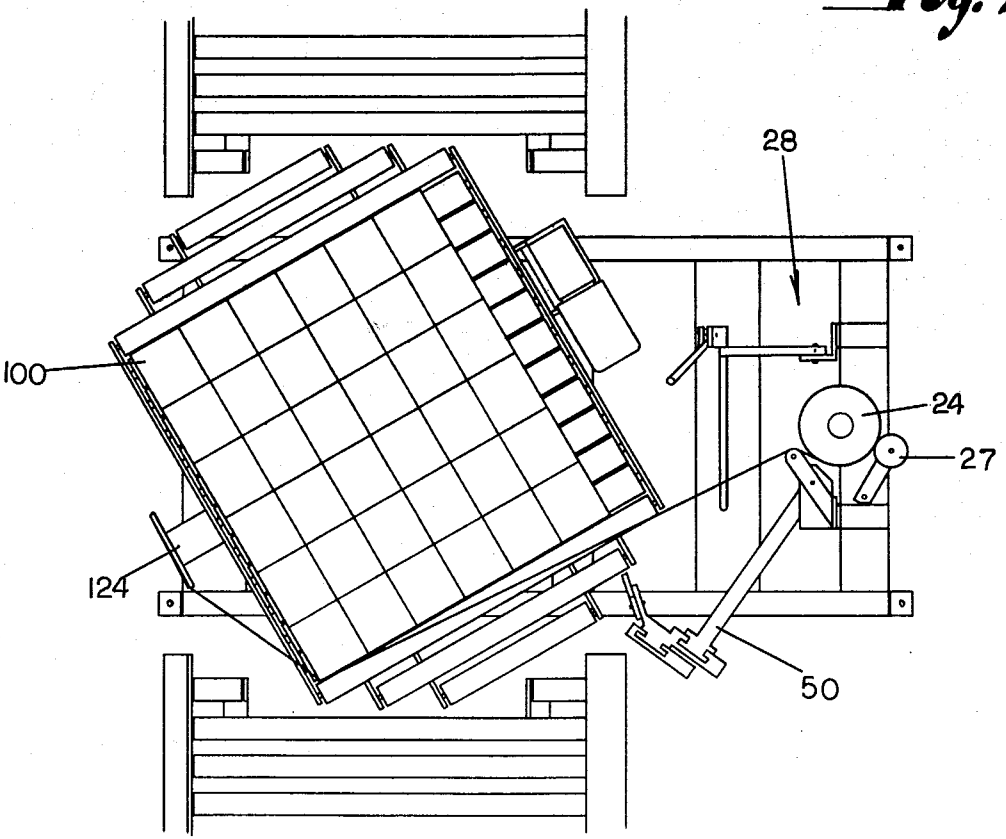
FIG. 11 is an enlarged plan view of the apparatus shown in FIG. 9 after the turntable has continued its rotation.
Figure 13:
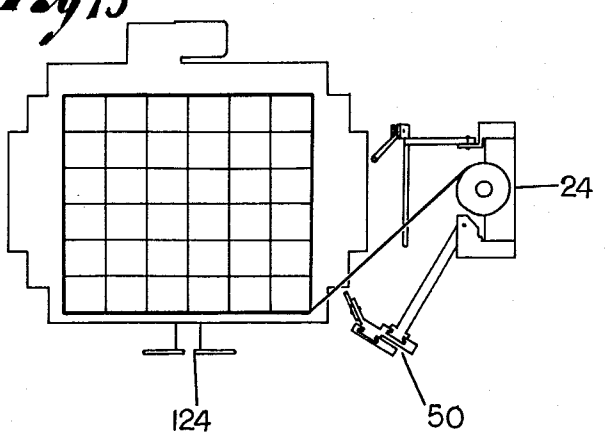
FIG. 13 is a plan view of the apparatus shown in FIG. 12.
Figure 12:
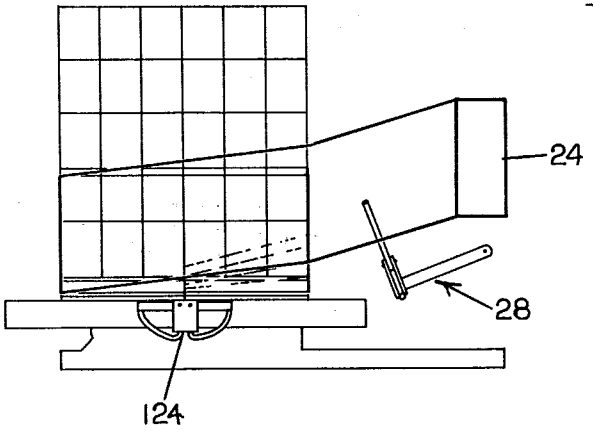
FIG. 12 is a side elevational view of the wrapping apparatus starting its wrapping operation up the load after the turntable clamp has been released.
Figure 15:
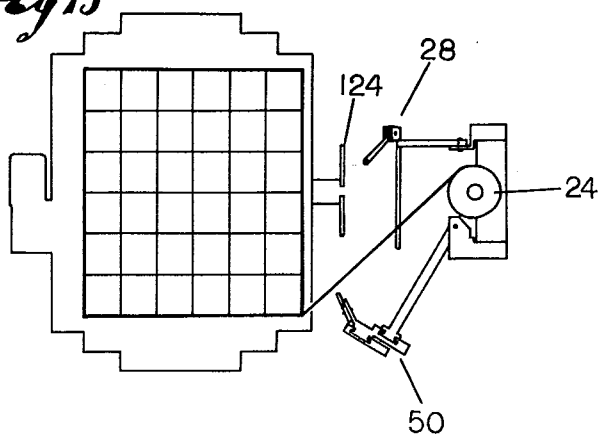
FIG. 15 is a plan view of the apparatus of FIG. 14.
Figure 14:
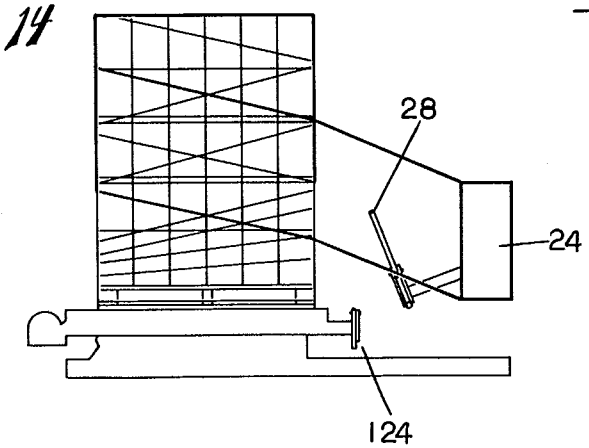
FIG. 14 is a side elevational view of the wrapping apparatus after the netting web has been wrapped up the load and has started back down the load.
Figure 17:
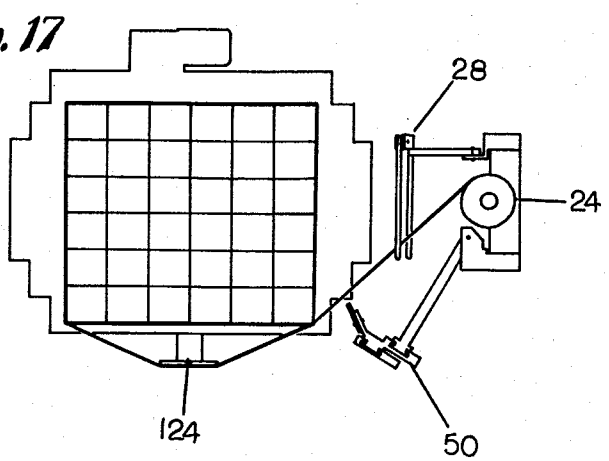
FIG. 17 is a plan view of the apparatus shown in FIG. 16.

A film roll support or carriage 20 is moveably mounted on the frame. The film roll carriage includes a film roll mandrel or vertical holding member which holds a roll of film of either a solid web material or of a netting configuration. The film roll carriage can be mounted in guides or tracks in the frame and is preferably driven by a rack and pinion drive although chain, screw or other known drives could be readily adapted to the invention. The film roll is restricted by the action of a magnetic particle brake 26 which subjects the film material to a braking force causing it to stretch as it is wrapped around the load. The restrictive force is preferably applied by utilizing a roller 27 as shown in FIG. 11 to engage the outside of the film roll and apply a constant force on the film roll uniformly stretching the film as it leaves the roll.

Figure 2:
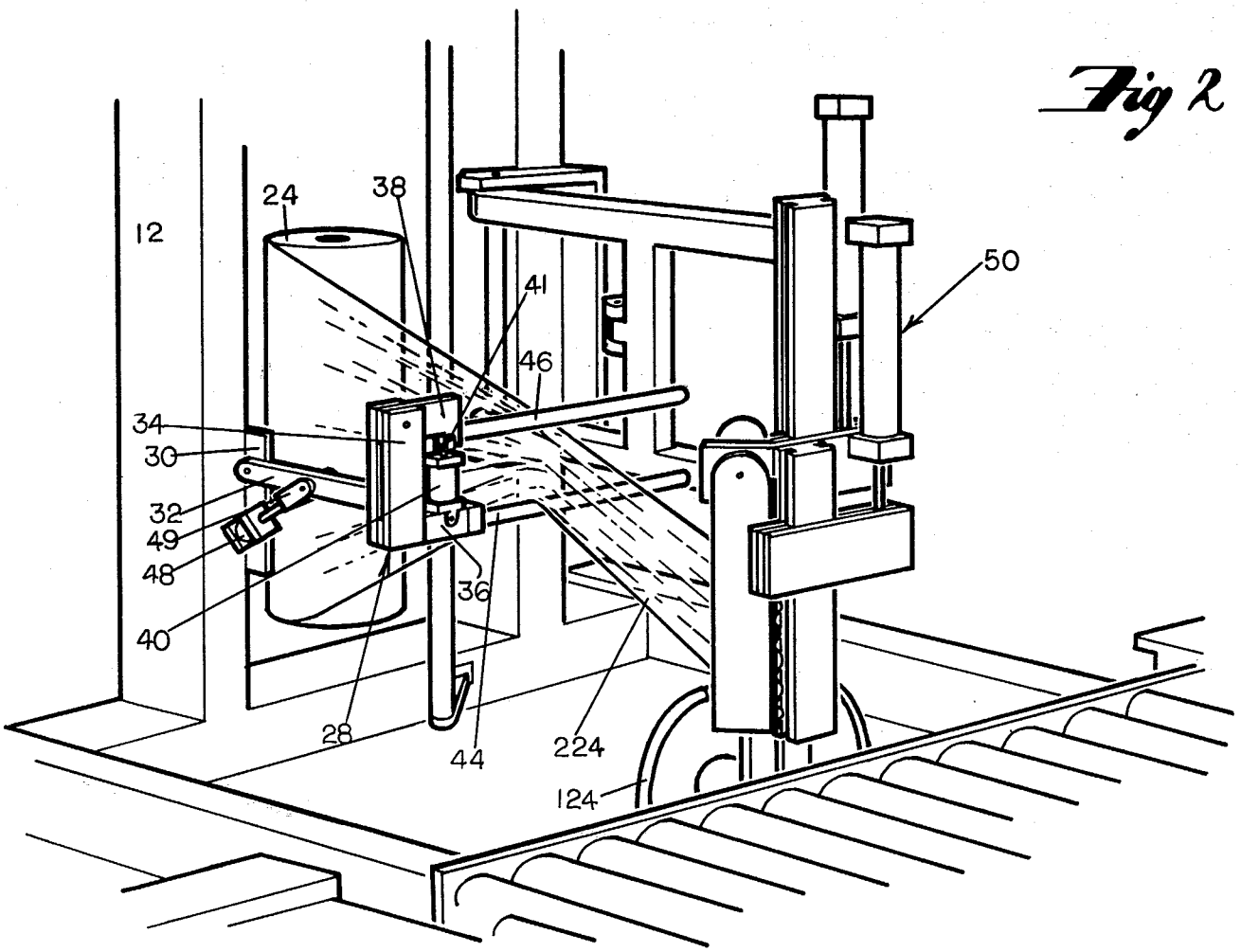
FIG. 2 is an enlarged isolated perspective view of the roping, clamping, cutting and tucking assemblies of the apparatus as shown in FIG. 1.
Figure 3:
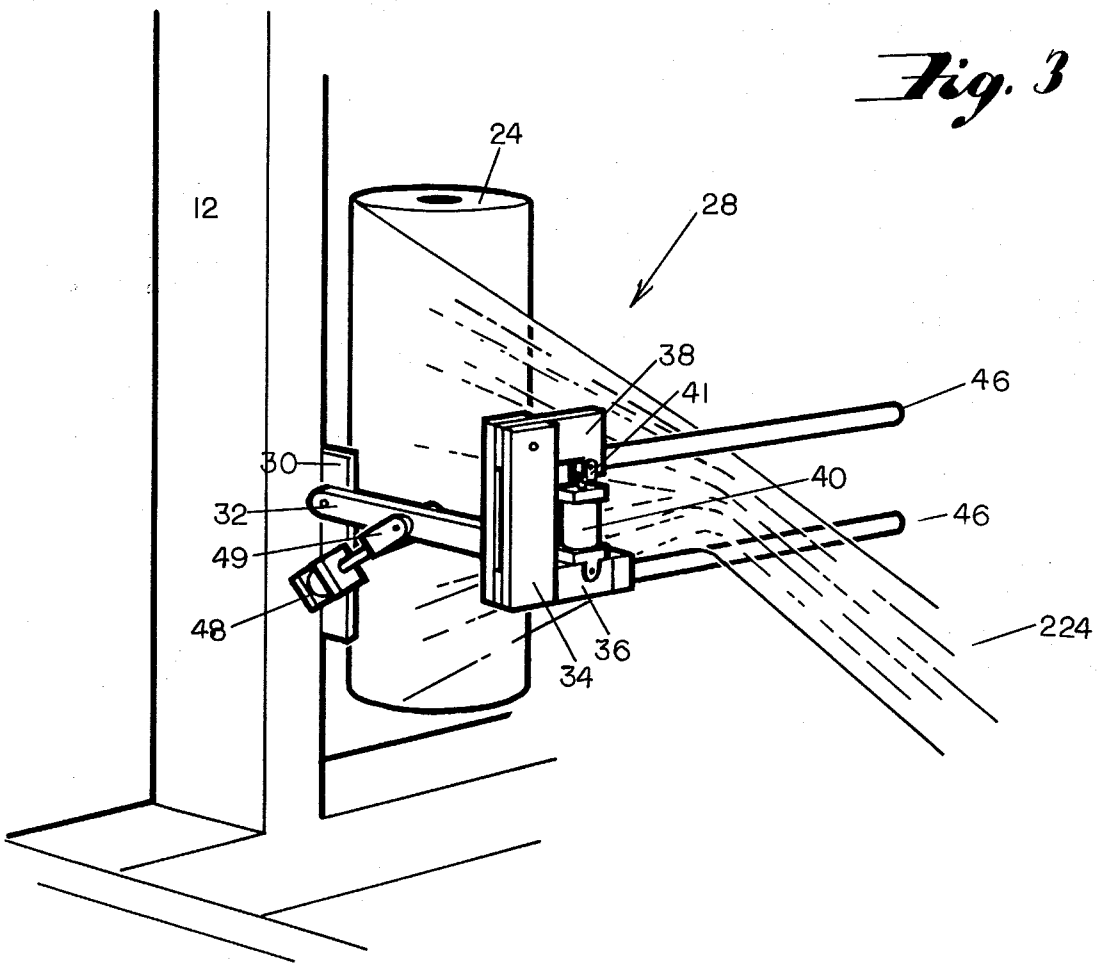
FIG. 3 is an enlarged isolated perspective view of the roping mechanism shown in the assembly of FIG. 2.

It should be noted that film, film material and netting are used interchangeably throughout the specification. The netting 224 as it comes off the netting roll 24 is stretched by the brake 26 and passed through a roper mechanism 28. The roper mechanism which is best shown in FIGS. 2 and 3 comprises a support plate 30 secured to the frame 12 and a rotatable support bar 32 having one end rotatably mounted to the support plate, the other end being secured to a support block 34. The support block 34 has a stationary leg 36 secured to it and a rotatable leg 38 rotatably mounted to the block above the stationary leg. A fluid activated cylinder 40 is mounted to the stationary leg 36 with an end 41 of its piston rod being connected by pin means to the rotatable leg 38. A linear roper rod 44 is secured to the stationary leg 36 and a similarly shaped moveable roper rod 46 is secured to the moveable rotatable leg 38.

A fluid activated cylinder 48 is secured to support plate 30 or the frame and has the end 49 of its piston rod connected to rotatable support bar 32. Thus cylinder 48 can be energized by known fluid circuitry to move the block 34 and its associated roper rods 44 and 46 up and down in a plurality of positions, while the cylinder 40 is energized to move the rotatable leg 38 and its associated roper rod 46 in an approximately 90° arc. The roper mechanism 28 is used to bunch the netting width into a convoluted width approximating a rope-like configuration, although it will be appreciated that the width of the bunched netting is greater than that which would be normally associated with a rope. The netting is preferably bunched into a convoluted width which is less than 50% of its original web width. The netting film that is wrapped around the load is tucked into the load and severed from the load by a clamping, tucking and cutting mechanism 50.

Figure 4:
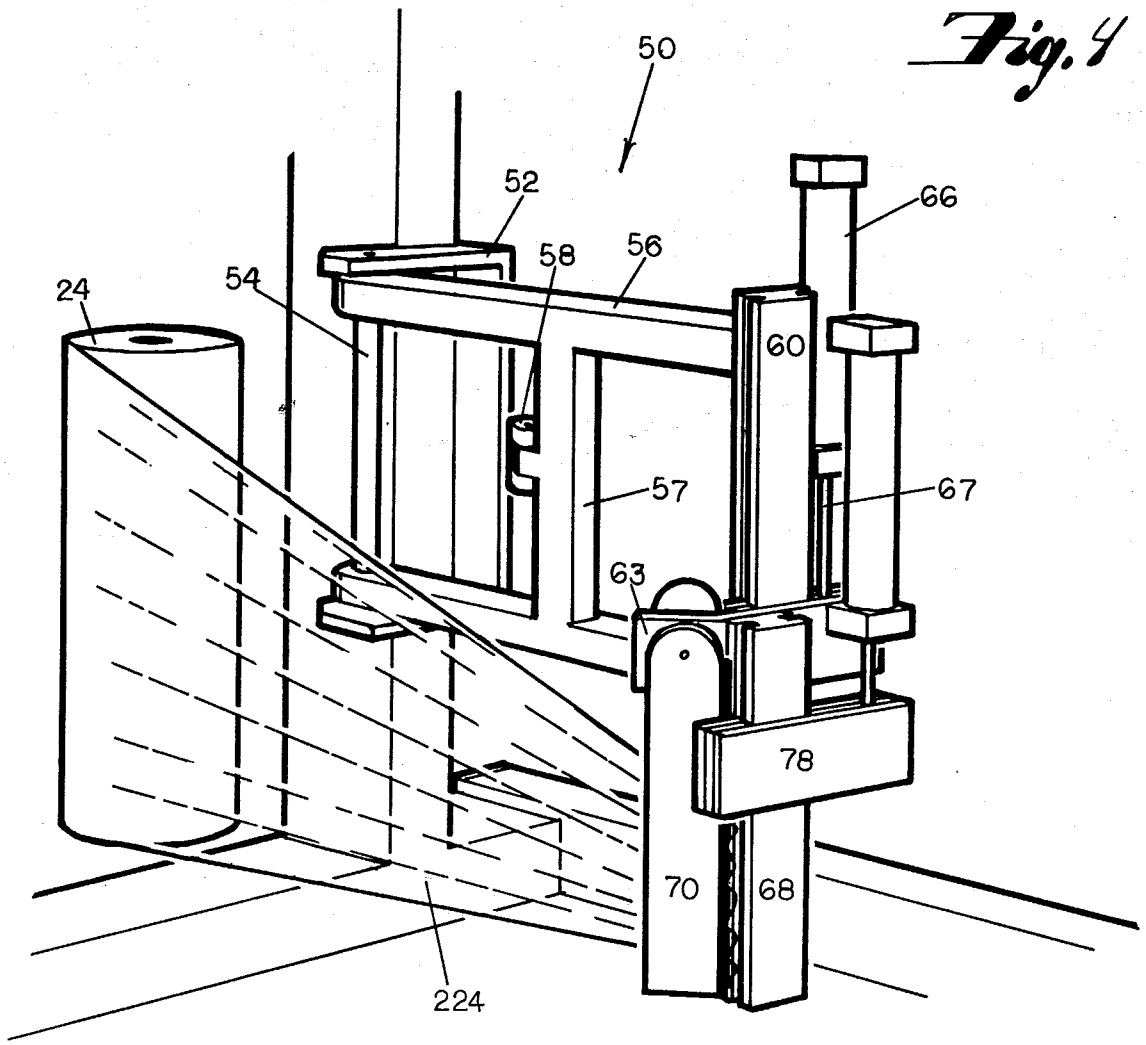
FIG. 4 is an enlarged isolated perspective view of the clamping, tucking and cutting mechanism shown in the assembly of FIG. 2.
Figure 5:
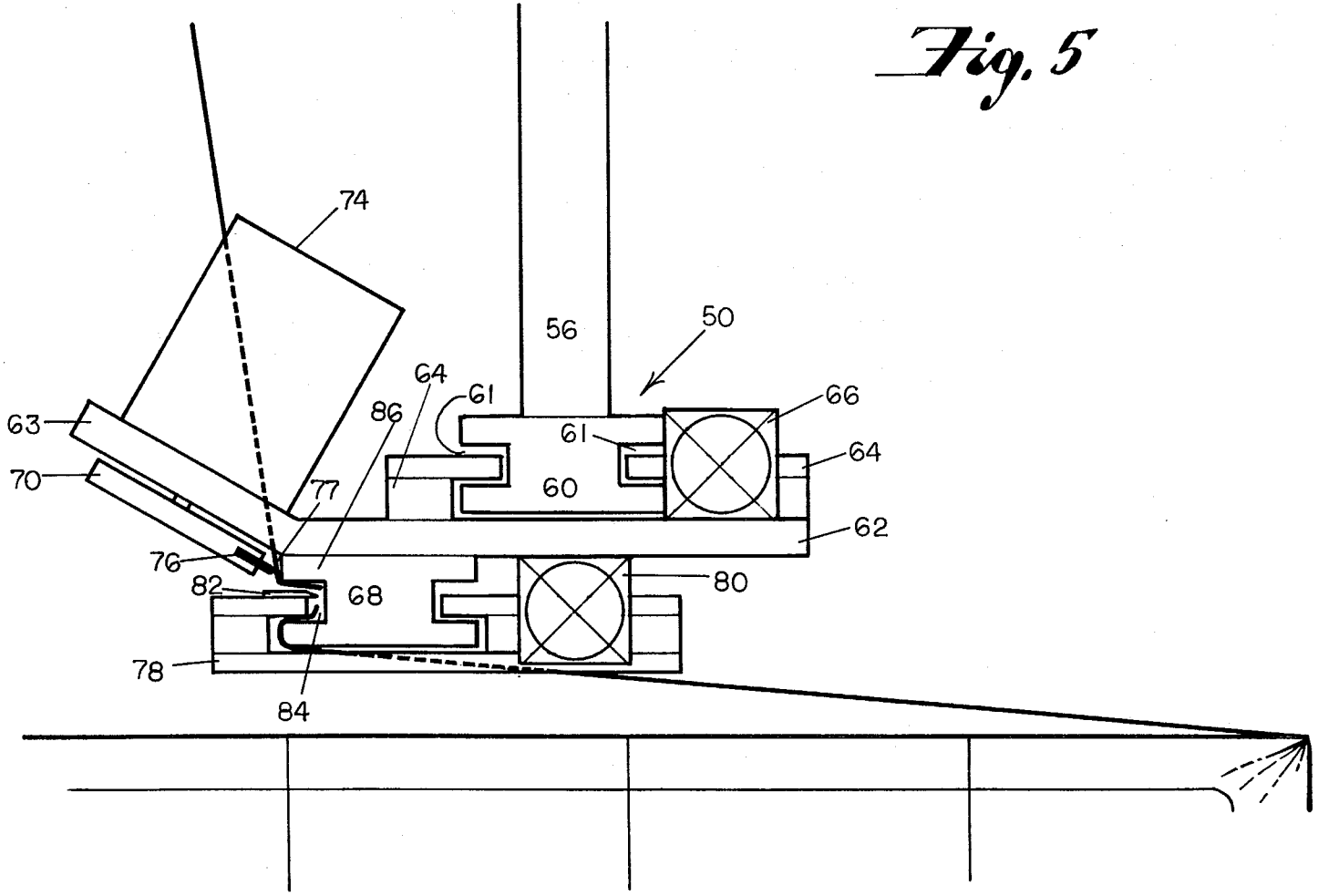
FIG. 5 is an enlarged plan view of the mechanism of FIG. 4 shown in the cutting mode.
Figure 7:
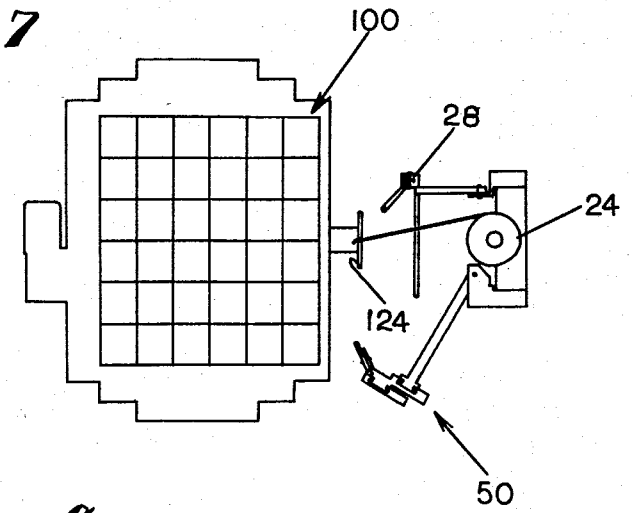
FIG. 7 is a plan view of the apparatus shown in FIG. 6.
Figure 9:
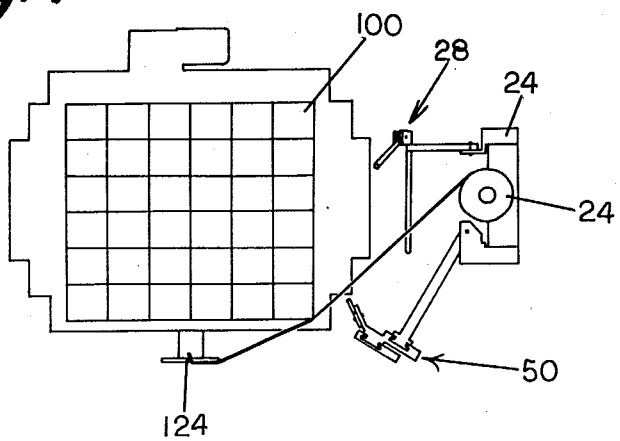
FIG. 9 is a plan view of the apparatus shown in FIG. 8.
Figure 6:
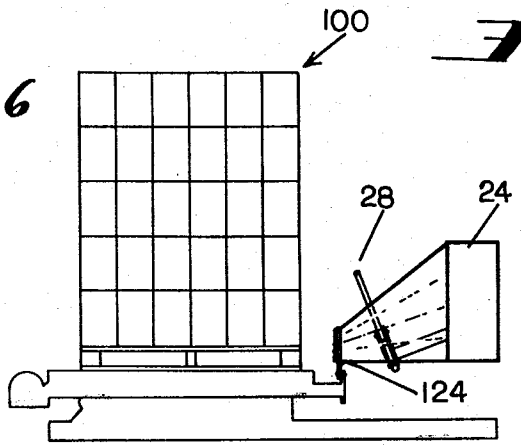
FIG. 6 is a side elevational view of the wrapping apparatus at the start of the wrap cycle.
Figure 8:
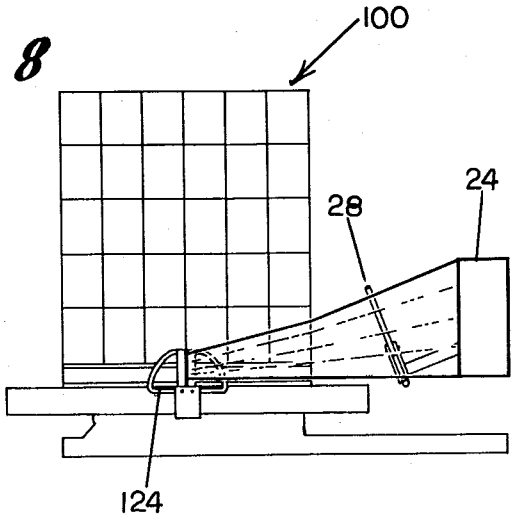
FIG. 8 is a side elevational view of the wrapping apparatus shown after a quarter revolution of the turntable at the beginning of the wrap cycle.
Figure 10:
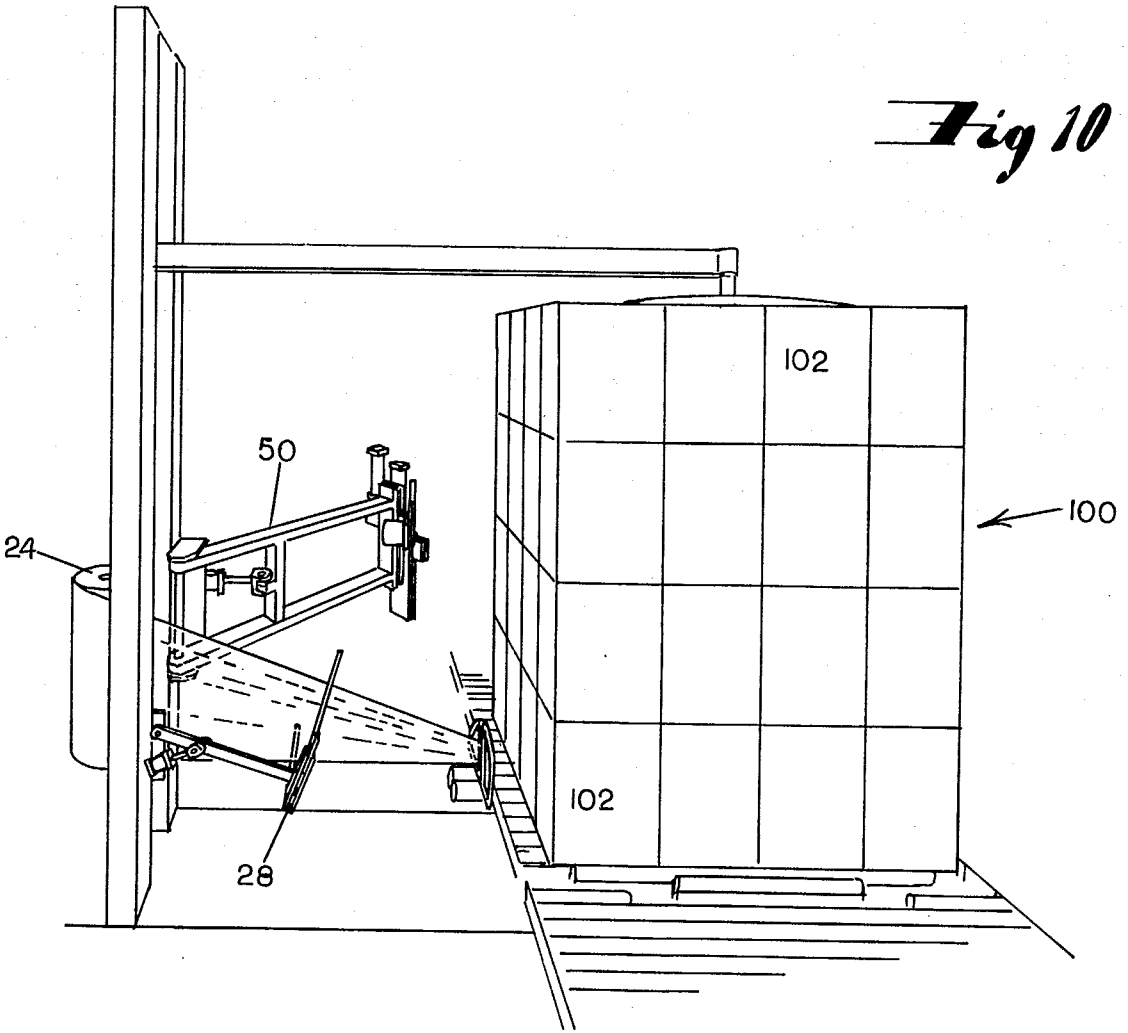
FIG. 10 is an enlarged perspective view of the apparatus in the same operational mode shown in FIG. 6.

The clamping, tucking and cutting mechanism 50 is best shown in FIGS. 2, 4 and 5 and is supported by a bracket 52 secured to the frame and a support rod 54 mounted in the bracket. The support rod 54 supports an H-shaped support member 56 which is rotatably moved around the support rod 54 by a fluid operated cylinder having its piston rod connected at 58 to the middle support arm 57 of the support member 56.

A grooved tuck guide bar 60 is secured to the ends of the H-shaped support member 56 and supports the clamping, cutting and tucking components of the apparatus. A horizontally angularly bent clamp plate 62 having a guide assembly 64 secured thereto is adapted to seat and ride in the grooves 61 of the tuck guide bar 60. The clamp plate and its guide assembly is transported by a fluid operated cylinder 66 which is secured to the tuck guide bar 60. When cylinder 66 is energized its piston rod 67 which is secured to the guide assembly 64 pushes or pulls the bent clamp plate 62 along the tracks formed by grooves 61 of the guide bar 60. A grooved clamp bar 68 is secured to the horizontal clamp plate 62 and extends downward from the horizontal clamp plate perpendicular to the horizontal clamp plate 62. Adjacent to the grooved clamp bar 68 is a rotary clamp leg 70 which is rotatably mounted on the angled segment 63 of the horizontal clamp plate 62. The rotary clamp leg 70 is rotated by cylinder 74 and is rotated away from the clamp bar 68 before the clamp bar 68 is moved into the film path and is then returned toward the clamp bar 68, so that a flexible clamp strip 76 mounted to the clamp leg 70 engages the netting and holds it in a clamped position against edge 77 of the clamp bar 68. This orientation is best shown by FIG. 5. A channelled cutter bar 78 is moveably mounted on the grooved clamp bar 68 and is reciprocated along the surface of the clamp bar by a fluid cylinder 80 which is secured to the horizontal clamp plate 62 and has its piston rod connected to cutter bar 78. When the netting is held in the clamping assembly and the clamping assembly is fully extended as shown in FIG. 4, the cutter bar 78 is transported by the piston rod and slid along the surface of the clamp bar 68, so that a knife blade 82 mounted on the outer surface of the cutter bar 78 engages the stretched netting tauntly held across groove 84 to sever the netting. After the netting is severed a new leading edge is held in the clamped position between the clamp strip 76 and edge 77 of leg 86 of clamp bar 68. The trailing edge returns to its normal memory position and pulls out of the groove 84 as is partially shown in FIG. 5.

Another element of the apparatus not previously described are the turntable clamps 124, which are rotated in the same manner as the rotary clamp leg 70. The function of the turntable clamps will be described more fully in the operation of the apparatus.

In the operation of the apparatus, the end of the stretched film webbing which is preferably netting, is manually placed between the turntable clamps 124. At this stage the clamping, tucking and cutting mechanism 50 is in the retracted position, and the roper mechanism 28 is opened by raising the rotatable leg 38 and rod 46 to its maximum extended position. The load 100 is moved onto the turntable 108 by power conveyor 106. The turntable is then rotated by an appropriate driving mechanism (not shown) which is well known in the art and braking force is applied to the web of stretchable material causing it to be substantially stretched anywhere from 5% to 200%. After one and one half revolutions of the turntable 108 the material roll support carriage 20 is driven upward and the turntable clamps 124 open. When the stretched netting material reaches the top of the load 100 the roll carriage stops its upward travel and remains in that position until a number of predetermined wraps are accumulated around the top of the load for stability or packaging reasons. Once the predetermined number of wraps have been accumulated around the top of the load, the carriage moves downward carrying its associated roll of netting until it reaches its original position thereby covering the load with two spiral overwraps of stretched netting material.

Figure 16:
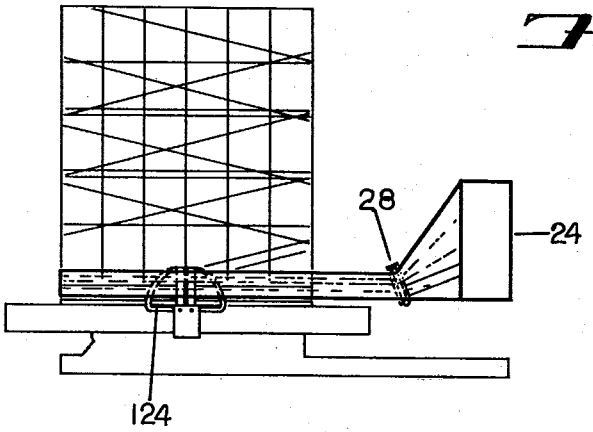
FIG. 16 is a side elevational view of the wrapping apparatus showing the roped netting wrapped around the turntable clamps.
Figure 19:
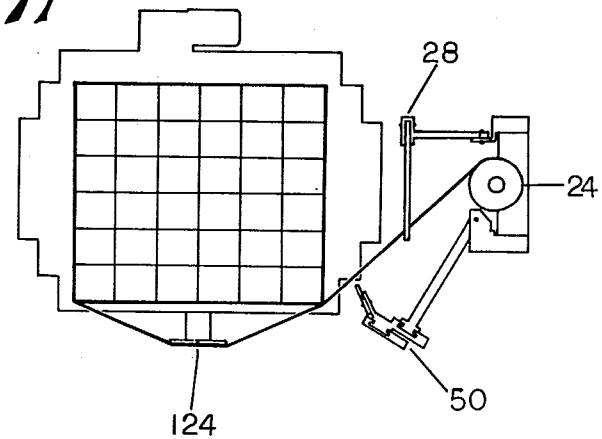
FIG. 19 is a plan view of the apparatus shown in FIG. 18.
Figure 18:
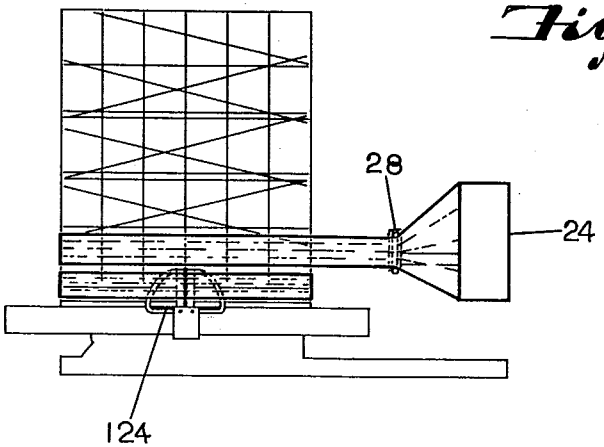
FIG. 18 is a side elevational view of the apparatus after the roper mechanism has directed a second wrap of the roped netting above the first wrap of roped netting.
Figure 21:
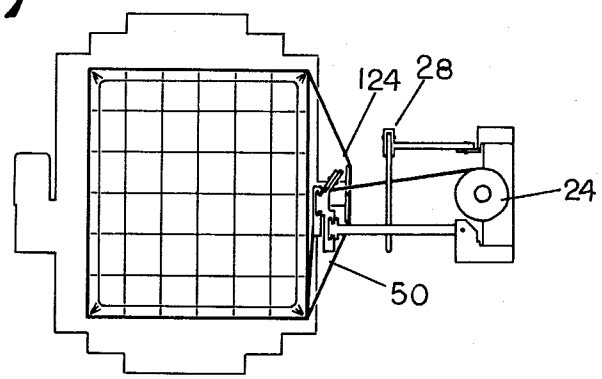
FIG. 21 is a plan view of the apparatus shown in FIG. 20.
Figure 23:
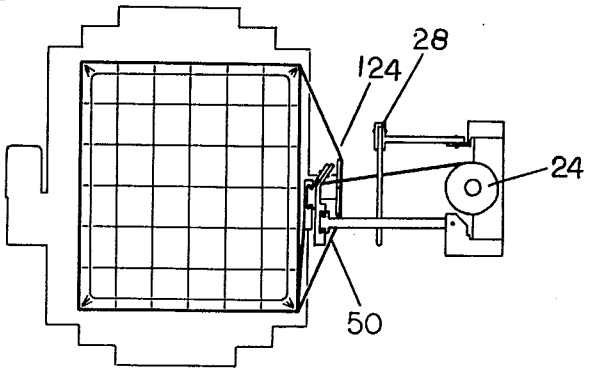
FIG. 23 is a plan view of the apparatus shown in FIG. 22.
Figure 20:
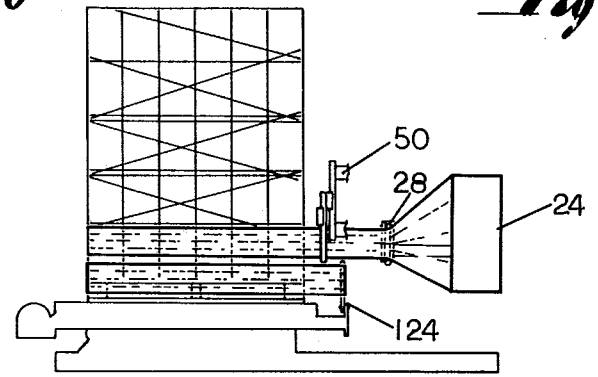
FIG. 20 is a side elevational view of the wrapping apparatus showing engagement of the cutting and clamping mechanism with the roped netting.
Figure 22:
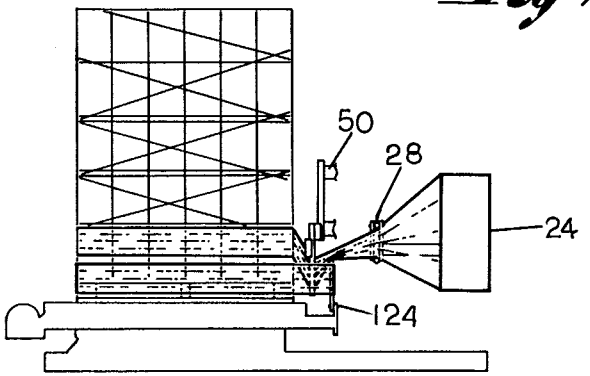
FIG. 22 is a side elevational view of the wrapping apparatus showing the wrapping mode in which the cutting and clamping mechanism tucks the netting under an underlying layer of netting.
Figure 24:
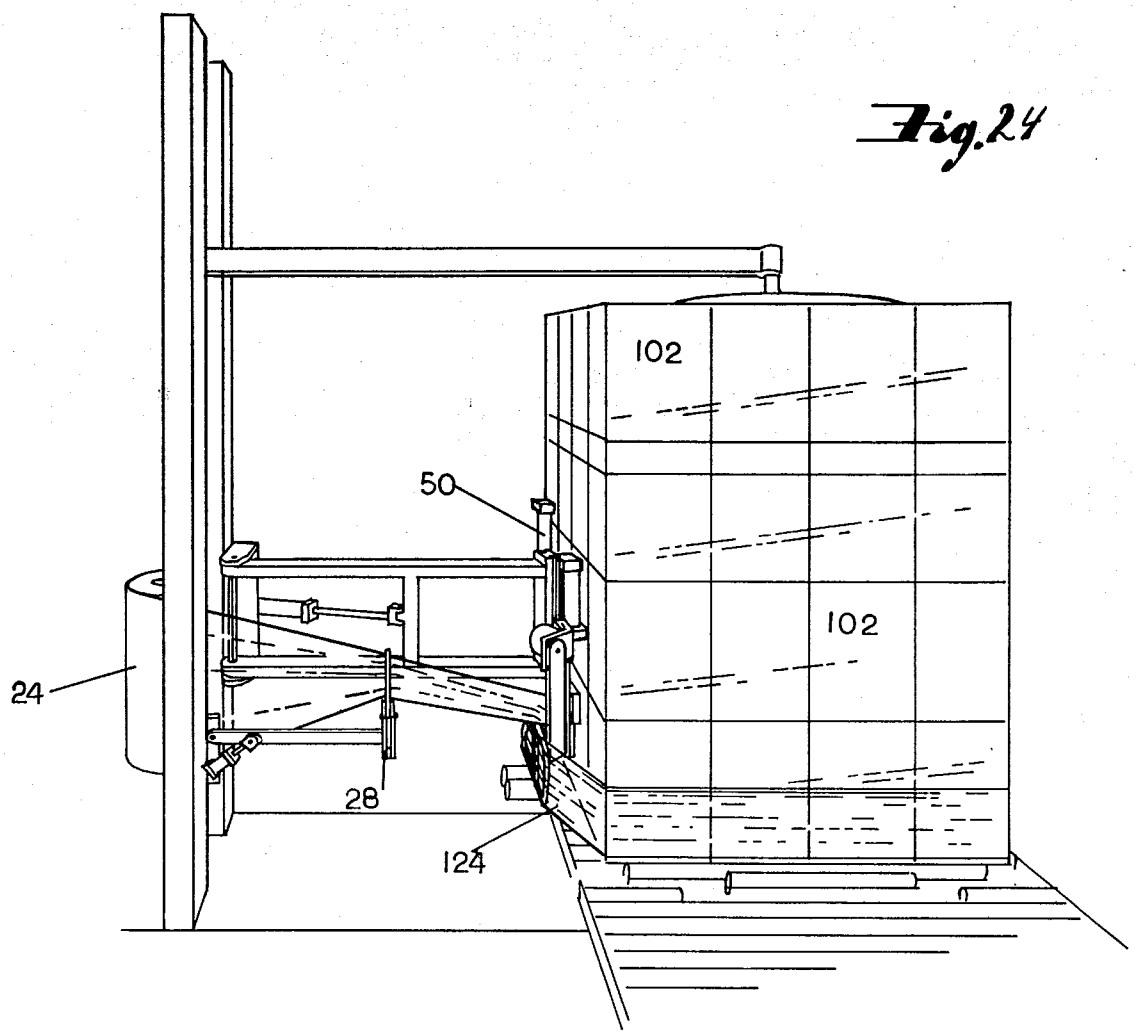
FIG. 24 is an enlarged perspective view of the apparatus shown in FIG. 20.
Figure 25:
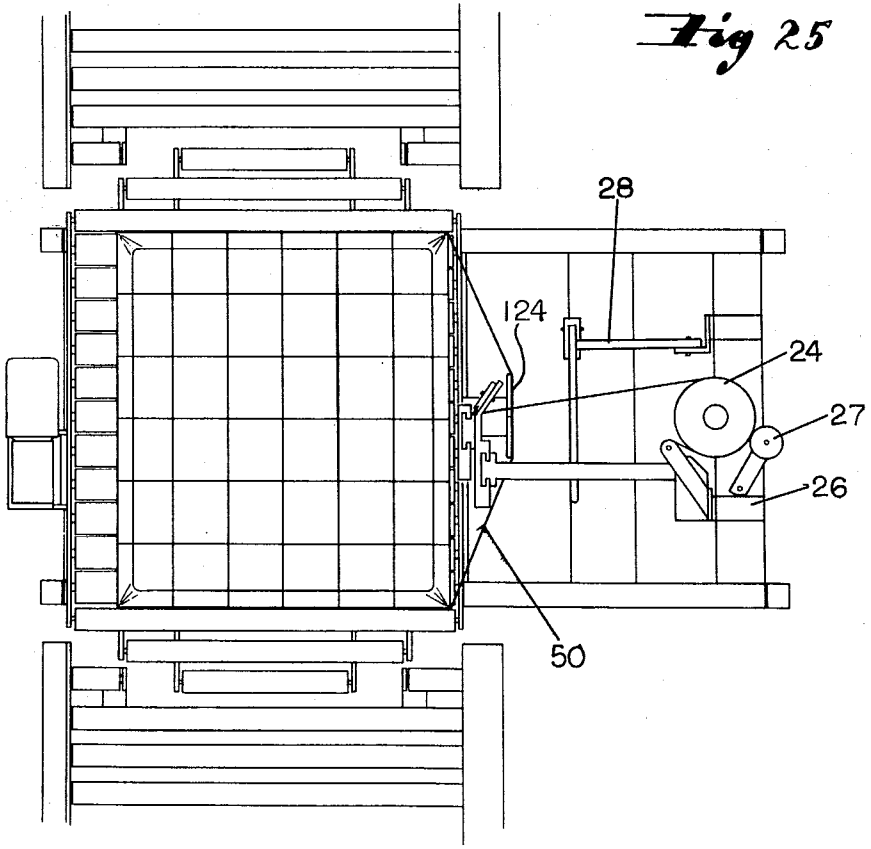
FIG. 25 is an enlarged plan view of FIG. 23.
Figure 27:
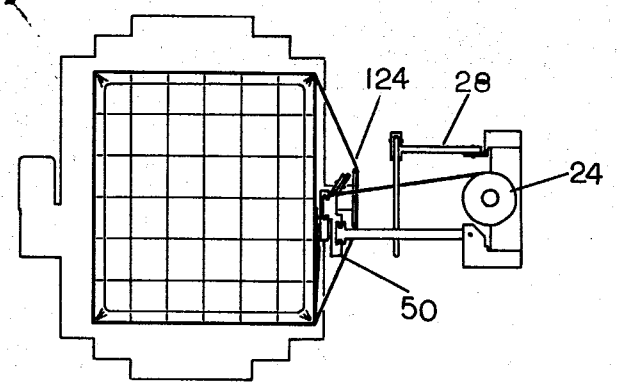
FIG. 27 is a plan view of the apparatus shown in FIG. 26.
Figure 26:
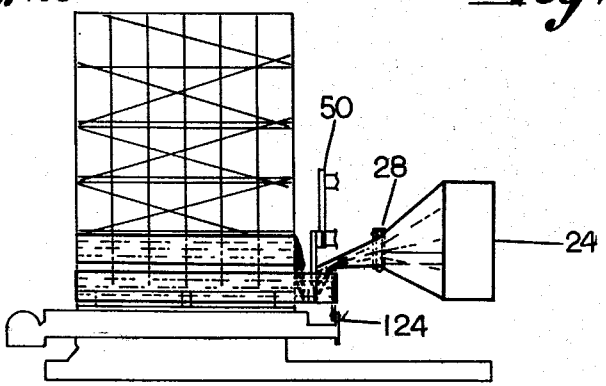
FIG. 26 is a side elevational view of the wrapping apparatus disclosing the cutting mode of the operation.
Figure 29:
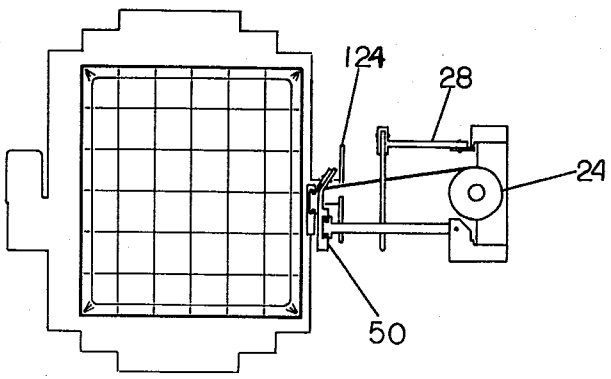
FIG. 29 is a plan view of the apparatus shown in FIG. 28.
Figure 28:
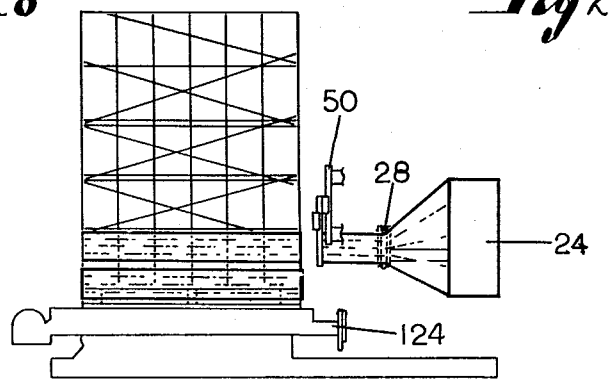
FIG. 28 is a side elevational view of the wrapping apparatus disclosing the netting web clamped and held away from the load.
Figure 31:
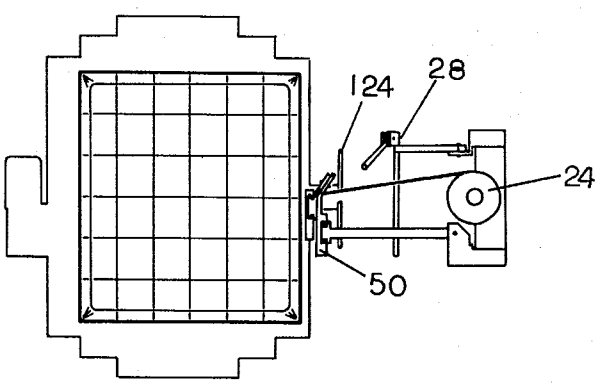
FIG. 31 is a plan view of the apparatus shown in FIG. 30.
Figure 30:
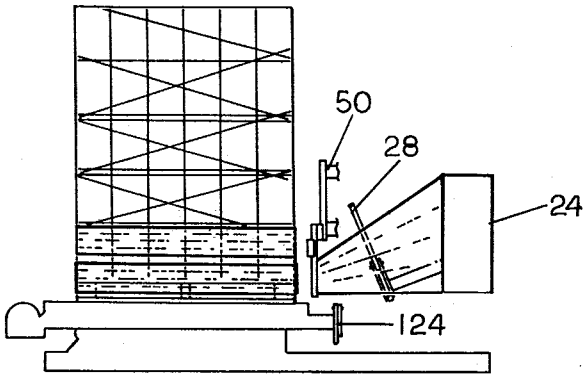
FIG. 30 is a side elevational view of the wrapping apparatus in which the netting is carried down for engagement with the turntable clamp.
Figure 33:
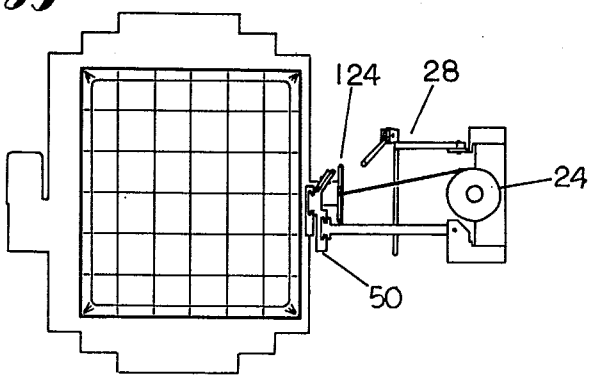
FIG. 33 is a plan view of the apparatus shown in FIG. 32.
Figure 32:
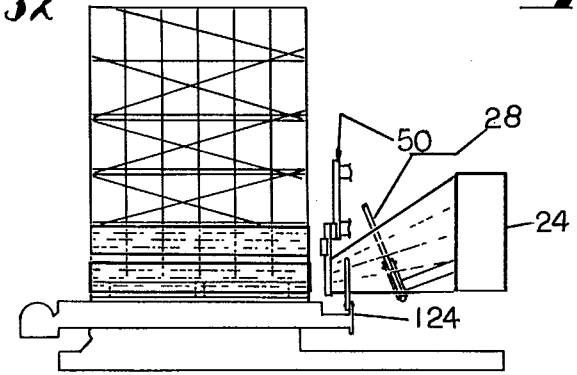
FIG. 32 is a side elevational view of the wrapping apparatus showing engagement of the netting by the turntable clamp with the next operational mode of the operation being that shown in FIG. 6.

The turntable continues to rotate and the turntable clamps 124 come up from beneath the surface of the turntable while the upper rotatable roping rod 46 comes down over the stretched material to bunch the material and rope the material around the turntable clamps as shown in FIG. 16. The web of stretched material is formed into a convoluted rope configuration by the roping rod preferably having a width less than 50% of the width of the web of material dispensed from the roll. The turntable continues to rotate as both roping rods are raised as shown in FIG. 18 to rope the material a second revolution just above the top of the turntable clamps. The turntable then stops in its home position and the clamping, tucking and cutting mechanism 50 is extended into the material path by its cylinder to push the roped web of material above the turntable clamps into the middle of a space defined by the outer surface of the load and a line drawn upward from the inner surface of the turntable clamps. The rotary clamp leg 70, which was previously in its raised position is rotated downward to clamp the material into a fixed position at which time the tuck cylinder 66 lowers the horizontal clamp plate 62 and its associated members behind the turntable clamps between the spiral wrap and the first rope wrap. The cutter cylinder 80 then activates the cutter bar 78, so that the knife blade 82 is thrust downward cutting the bunched stretched material on the load side of the roped wrap while retaining the end of the stretched material leading to the supply roll to form a new leading edge of material. This leaves the severed end or trailing edge of stretched material between the rope wrapped around the turntable clamps and the load. The turntable clamps 124 release the roped material and are retracted, with the tuck cylinder 66 being activated to raise the horizontal clamp plate 62 and its associated assembly out of the path of the contracting roped wrap trapping the severed trailing edge of material underneath the stretched lower roped wrap as it returns to its original memory position.

The tuck cylinder 66 is activated to lower the clamping mechanism which is still clamping the new leading edge of material. The turntable clamps 124 then move upward to engage and hold the new leading edge of material as rotary clamp cylinder 74 rotates the rotary clamp leg 70 upward to release the stretched material, at which time the clamping, tucking and cutting mechanism 50 is carried away to its home position.

The wrapped load is then conveyed off of the turntable 108 by power conveyor 110 and the next load is conveyed onto the turntable adjacent the upstanding turntable clamps holding the film in place to begin the next wrap.

In the foregoing description the invention has been described with reference to a particular preferred embodiment although it is to be understood that the specific details shown are merely illustrative and that the invention may be carried out in other ways without departing from the true spirit and scope of the following claims.

What is claimed is:

1. A process of making a spiral wrapped unitary package from a load comprising a plurality of units comprising:

a. placing a leading edge of a roll of stretchable material from a dispensing means adjacent a load;

b. holding said leading edge of said roll of stretchable material in a fixed position adjacent said load;

c. applying tension to the roll of stretchable material so that the material is stretched as it is removed from said roll and wrapped around said load as the load is rotated;

d. moving the dispensing means in a directon parallel to the center axis of the load away from one end of the load to form a plurality of overlapping wraps on the surface of the load;

e. moving the dispensing means in an opposite direction from its first direction away from the other end of the load to form a plurality of overlapping wraps on the wrapped surface of the load;

f. applying a force on the material web to reduce its width to a width less than 50% of its original web width;

g. wrapping said reduced width material web around a part of said load and a structure positioned adjacent to but spaced away from said load which separates said reduced width web from said load a predetermined distance sufficient to allow substantially unrestricted entry of a tucking mechanism;

h. continuing the wrap of said reduced width material around said load and holding a portion of said reduced width material in a fixed position in a tucking mechanism;

i. carrying said held portion of material into a space formed between the load surface and the material web wrapped around said structure; and j. severing the material web from said dispensing means and releasing the reduced width web removed from said load surface so that it is pulled inward by the material trying to reach its normal memory state thereby holding the severed edge in a fixed position under its wrapping surface.

2. A process of making a unitary package from a load comprising a plurality of units comprising:

a. placing a leading edge of a web of a roll of stretchable material from a dispensing means adjacent a load and holding said leading edge of said roll of stretchable material adjacent to said load;

b. applying tension to the stretchable material so that the material is stretched as it is removed from the roll;

c. causing relative movement between said roll and said load so that stretched material is wrapped around said load;

d. moving the dispensing means in a direction parallel to the center axis of the rotating load away from one end of the load to form a plurality of overlapping wraps on the surface of the load;

e. moving the dispensing means in an opposite direction from its first direction away from the other end of the load to form a plurality of overlapping wraps over the wrapped surface of the load;

f. wrapping said stretched material web around said load and a retractable structure positioned away from said load which causes said stretched material web to be spaced away from said load a sufficient distance to allow substantially unrestricted entry of a tucking mechanism;

g. continuing the wrap of said stretched material web around said load and clamping a portion of said stretched material web with a vertically reciprocating tucking mechanism adjacent the space between said load and said structure;

h. transporting said clamped material web by moving said reciprocating mechanism into the space between the load surface and the material web wrapped around said structure; and i. severing the held material from said dispensing means and releasing the stretched material web wrapped around said structure by retracting said structure, so that the web formerly engaging the structure is pulled inward by the material trying to reach its normal memory state holding the severed portion of material in a fixed position under its wrapping surface.

3. An apparatus for making a unitary package by wrapping a web of stretched material on a load comprising a plurality of units comprising a frame, a carriage moveably mounted on said frame, said carriage being adapted to hold a roll of stretchable material for rotation, a turntable adapted to support a load positioned adjacent said frame, a spacer means connected to said turntable adapted to hold a web of material, drive means connected to said turntable and adapted to rotate said turntable and an associated load mounted on said turntable to cause a web of material to be pulled from a roll of material held by said carriage to overwrap said load, said spacer means moving into and out of the path of the moving web to space the film a predetermined distance from an underlying wrap allowing insert means entry thereinto, brake means connected to said roll, said brake means being adapted to restrict movement of the web of material from said roll, so that said material is stretched as it leaves said roll, means to drive said carriage reciprocally along said frame so that a plurality of overlapping layers of material are placed on said load to form a wrap, said carriage being driven along the frame in one direction to provide a wrap for a load and returning in an opposite direction while continuing to wrap the load, roper means mounted adjacent the material path, said roper means comprising a plurality of members which engage said material web to form said film web into a rope-like structure, and insert means mounted to said frame to clamp said roped material web and insert said roped web underneath said stretched material wrapped around said load and turntable spacer means, said insert means including cutting means connected thereto for severing said material web from said material roll dispenser.

4. Apparatus as claimed in claim 3 wherein said insert means comprises a frame, a moveable clamp means mounted to said frame, said moveable clamp means including a clamp bar adapted to engage said web of material and hold said web of material against another member in a fixed position, means to transport said clamp means and a cutter means comprising a cutter assembly adapted to sever said material from said material dispenser.

5. Apparatus as claimed in claim 3 wherein said brake means comprises a roller assembly and a particle brake operatively connected to said roller assembly causing said roller assembly to apply restrictive force on the exterior of said netting roll to uniformly stretched said material.

6. Apparatus as claimed in claim 3 wherein said stretched material is a perforated film.

7. An apparatus for making a unitary package by wrapping a web of stretched material around a load comprising a plurality of units comprising a vertical frame, a carriage moveably mounted on said frame, a roll of stretchable material rotatably mounted on said carriage, brake means connected to said roll of stretchable material to restrict the material being dispensed from the material roll stretching the same, a turntable adapted to support a load positioned adjacent to said frame, turntable material clamp means moveably mounted to said turntable, drive means connected to said turntable and adapted to rotate said turntable and associated load placed on said turntable causing stretched material from said roll of material held by said carriage to overwrap said load, means for moving said clamping means into and out of the path of the moving web and thereby wrapping said claimps at the end of the wrapping operation, an automatically operated mechanism to selectively convolute said stretched material positioned adjacent said frame, said convoluting means mechanism being movable and placed so that it will selectively receive the width of said material and form it into a convoluted configuration having a width less then 50% of the width of the stretched material dispensed from the material roll, clamping and tucking means mounted downstream from said convoluting means mechanism to receive said formed convoluted material including clamp means to hold said convoluted material in a clamped position and a transporter mechanism to vertically insert said convoluted material between a stretched convoluted material wrapped around said turntable material clamp and load and means to sever said stretched convoluted material from said dispenser roll.

8. An apparatus for making a unitary package comprising a vertical frame, a carriage moveably mounted on said frame, a roll of stretchable netting material rotatably mounted on said carriage, brake means connected to said roll of stretchable netting material to restrict the material being dispensed from the netting roll stretching the same, a turntable adapted to support a load positioned adjacent to said frame, turntable material clamp means moveably mounted to said turntable, drive means connected to said turntable and adapted to rotate said turntable and an associated load placed on said turntable causing stretched netting from said roll of netting material held by said carriage to overwrap said load, means for moving said clamping means into and out of the path of the moving web and thereby wrapping said claimps at the end of the wrapping operation, means to selectively convolute said netting material positioned adjacent said frame, said convoluting means being moveable and placed so that it will receive the width of said web of netting material and form it into a convoluted configuration having a width less than 50% of the width of the web of stretched netting dispensed from the netting roll, clamping and tucking means mounted downstream from said convoluting means to receive said convoluted material from said convoluting means, said clamping and tucking means including means to hold said convoluted material after at least one wrap of convoluted material has been wrapped around said turntable clamp means, said holding means being mounted on a carrying assembly and means to insert said carrying assembly and said convoluted material between said convoluted overwrap of said clamp means and said overwrapped load and means mounted to said clamping and tucking means to sever said convoluted material from said dispenser roll, said severing means comprising a slideable knife assembly reciprocally mounted to a guide member secured to said clamping and tucking means and means to drive said knife assembly along said guide member.

9. An apparatus as claimed in claim 8 wherein said clamping and tucking means comprises a moveable support, a guide bar secured to said moveable support, a support plate mounted on said guide bar, a cutter assembly mounted to said support plate, and a clamp means secured to said support plate.

10. An apparatus as claimed in claim 9 wherein said clamp means comprises a rotary cylinder mounted to said support plate, an arm mounted to said rotary cylinder and rotatably moved thereby, said arm having one edge in which a flexible clamp member is mounted.

11. An apparatus as claimed in claim 9 wherein said cutter assembly comprises a guide member mounted to said support plate, a fluid cylinder mounted to said support plate, a cutting support member secured to one end of said fluid cylinder, said cutting support member being mounted to said guide member secured to said support plate and extending therefrom, said cutting support member defining a blade holder, a blade mounted in said blade holder, said blade being carried by said blade holder so that it is transported along a groove formed in said guide member to sever material held across said groove.

12. An apparatus for making a unitary package comprising a vertical frame, a carriage moveably mounted on said frame, a roll of stretchable netting material rotatably mounted on said carriage, brake means connected to said roll of stretchable netting material to restrict the material being dispensed from the netting roll stretching the same, a turntable adapted to support a load positioned adjacent to said frame, turntable material clamp means moveably mounted to said turntable, drive means connected to said turntable and adapted to rotate said turntable and an associated load placed on said turntable causing stretched netting from said roll of netting material held by said carriage to overwrap said load, means for moving said clamping means into and out of the path of the moving web and thereby wrapping said claimps at the ends of the wrapping operation, means to selectively form said web of netting material into a rope-like configuration, said roper means being positioned adjacent said frame, means to move said roper means vertically with respect to said turntable, said roper means being provided with at least one moveable member allowing it to receive the web of said netting material and selectively form it into a rope-like configuration having a width less than the width of the web of the stretched netting material, clamping and tucking means mounted downstream from said roper means to receive roped netting material including means to hold said roped netting material after at least one wrap of roped netting material had been wrapped around said turntable clamp means and means to insert said held roped netting material between the wrap around said turntable clamp means and said load said insert means comprising a frame, a moveable clamp means mounted to said frame, said moveable clamp means including a clamp bar adapted to engage said netting material and hold said netting against another member in a fixed position and means to transport said clamp means, and means mounted to said clamping and tucking means to sever said roped netting material from said dispenser roll, said severing means comprising a knife assembly reciprocally mounted to said clamping and tucking means.

13. An apparatus for making a unitary package comprising a vertical frame, a carriage moveably mounted on said frame, a roll of stretchable netting material rotatably mounted on said carriage, brake means connected to said roll of stretchable netting material to restrict the material being dispensed from the netting roll stretching the same, a turntable adapted to support a load positioned adjacent to said frame, turntable material clamp means mounted to said turntable, drive means connected to said turntable and adapted to rotate said turntable and an associated load placed on said turntable causing stretched netting from said roll of netting material held by said carriage to overwrap said load, means for moving said clamping means into and out of the path of the moving web and thereby wrapping said claimps at the end of the wrapping operation, means to selectively form the web of said netting material into a rope-like configuration positioned adjacent said frame, said selective roper means comprising a moveable support, a stationary member mounted to said support and a moveable member mounted to said support, said moveable member being adapted to engage said web of netting material to reduce the width of said netting material forming a rope-like configuration of netting material, said roper means being slelectively positioned so that it will receive the width of said web of netting material and form it into a rope-like configuration having a width less than 50% of the width of the web of stretched netting dispensed from the netting roll, a film handling assembly mounted downstream from said roper means to hold said rope-like configured material until at least one wrap of rope-like configured material formed by said roper means has been wrapped around said turntable clamp means, said film handling assembly comprising a moveable support member, a guide member secured to said moveable support member, a support plate moveably mounted on said guide member, means to move said support plate mounted on said guide member, a guide bar secured to said support plate extending downwards from said support plate, a clamp member rotatably mounted to said support plate adapted to engage said guide bar to form a clamp assembly and a cutter assembly moveably mounted on said guide bar, said cutter assembly including cylinder means mounted to said support plate adapted to move said cutter assembly along said guide bar, said clamp assembly holding the roped material with said support plate carrying the roped netting material held by the clamp assembly between the turntable clamp means and the load, said cutting assembly being activated to move down said guide bar and sever the roped netting material held by said cutting means after which the clamp assembly and the turntable clamps are retracted allowing the severed trailing edge of the roped wrap to be held by an overlying roped wrap.

14. An apparatus as claimed in claim 13 wherein said cutting assembly comprises a channeled member mounted on said guide bar, said channeled member defining two edges which extend into grooves defined by said guide bar and a blade member mounted to one of said edges, said blade member being adapted to engage roped netting material held by said clamp assembly across said guide bar groove and sever said roped netting material from said netting roll.

* * * * *